US006663502B2

(12) United States Patent
Nelson et al.

(10) Patent No.: US 6,663,502 B2
(45) **Date of Patent: *Dec. 16, 2003**

(54) CUSTOMIZABLE GOLF PUTTER HEAD

(75) Inventors: Michael J. Nelson, Campbell, CA (US); Douglas W. Anderson, Glendale, AZ (US); Gary L. Tuerschmann, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 18 days.

This patent is subject to a terminal disclaimer.

(21) Appl. No.: 10/252,792

(22) Filed: Sep. 23, 2002

(65) Prior Publication Data

US 2003/0022730 A1 Jan. 30, 2003

Related U.S. Application Data

(63) Continuation of application No. 09/766,216, filed on Jan. 19, 2001.

(51) Int. Cl.[7] ..... A63B 53/04

(52) U.S. Cl. ..... 473/324; 473/340; 473/350; 473/332

(58) Field of Search ..... 473/350, 244, 473/246, 247, 248, 251, 305, 307, 313, 314, 332

(56) References Cited

U.S. PATENT DOCUMENTS

| | | | | |
|---|---|---|---|---|
| 3,220,733 A | | 11/1965 | Saleeby | 273/171 |
| 3,749,408 A | | 7/1973 | Mills | 273/171 |
| 4,121,832 A | | 10/1978 | Ebbing | 273/171 |
| 5,230,509 A | | 7/1993 | Chavez | 273/171 |
| 5,275,413 A | | 1/1994 | Sprague | 273/194 B |
| 5,332,214 A | | 7/1994 | Tucker | 273/78 |
| 5,407,196 A | | 4/1995 | Busnardo | 273/78 |
| 5,437,447 A | | 8/1995 | Rigutto | 273/164.1 |
| 5,863,257 A | | 1/1999 | Busnardo | 473/246 |
| 5,899,817 A | | 5/1999 | Dunikoski | 473/314 |
| 6,095,931 A | * | 8/2000 | Hettinger et al. | 473/341 |
| 6,171,203 B1 | | 1/2001 | Huang | 473/305 |
| 6,273,831 B1 | | 8/2001 | Dewanjee | |
| 6,328,661 B1 | * | 12/2001 | Helmstetter et al. | 473/324 |

FOREIGN PATENT DOCUMENTS

| | | |
|---|---|---|
| GB | 2195546 | 4/1988 |
| GB | 2317572 | 4/1998 |

* cited by examiner

*Primary Examiner*—Paul T. Sewell
*Assistant Examiner*—Thanh P Duong
(74) *Attorney, Agent, or Firm*—Darrell F. Marquette

(57) ABSTRACT

A customizable golf putter head includes a face member and a back body both of which may be selected from a plurality of differently configured face members and back bodies. The face member has a cavity formed in its rear surface, and the back body has a mating section that is positioned within the cavity of the face member so that a parting line between the face member and the back body is concealed below a top ledge of the face member when the putter head is assembled. A hosel selected from a plurality of differently configured hosels is mounted on the face member, and an elastomeric membrane is positioned within the cavity of the face member so as to be interposed between the face member and the back body.

6 Claims, 3 Drawing Sheets

CUSTOMIZABLE GOLF PUTTER HEAD

This application is a continuation of application Ser. No. 09/766,216 filed Jan. 19, 2001, incorporated herein by reference.

BACKGROUND OF THE INVENTION

This invention relates generally to golf putters and, in particular, to a golf putter head which may be customized to meet an individual golfer's preferences.

Since putting is such a highly individualistic aspect of golf, many configurations of putter heads are available to satisfy the preferences of the individual golfer. Putter head configurations vary significantly and may have some effect on a golfer's confidence and ability when putting. Prior U.S. Pat. Nos. 5,407,196 to Busnardo; 5,437,447 to Rigutto; 5,230,509 to Chavez; and 5,275,413 to Sprague disclose two-piece putters which may be customized. The Busnardo and Rigutto patents both disclose specifically configured putter heads with interchangeable face plates for changing the loft angle of the ball striking face. The Chavez and Sprague patents both disclose putter heads with interchangeable rear weights for altering the weight and feel of the putter head. All of these prior putter heads are disclosed as having two pieces formed with substantially planar mating surfaces which provides the assembled putter head with a noticeable parting line between the two pieces. Some golfers find such parting lines objectionable and even distracting when putting.

SUMMARY OF THE INVENTION

In accordance with the present invention, a customizable putter head is disclosed. The putter head includes a face member and a back body which may be selected from pluralities of differently configured face members and back bodies. The face member includes a top ledge which extends between toe and heel ends of the face member, and a hosel extends upwardly from the top ledge for receiving one end of a golf shaft. In the preferred embodiment, the face member is formed without the hosel but with a socket formed therein so as to open upwardly onto the top ledge. A plurality of differently configured hosels are provided with each hosel having a depending extension which fits into the socket formed in the face member. When a desired hosel has been selected, a sintering process may be used to secure the hosel and the face member together. The face member has a front surface arranged for striking a golf ball and a rear surface. The top ledge is disposed between the front and rear surfaces. A cavity formed in the rear surface has a recessed bottom surface with the cavity being circumscribed by a rim surface.

The back body has a mating section with a shape which matches the shape of the cavity in the rear surface of the face member so that when the putter is assembled, the mating section of the back body will be disposed within the face member cavity. When the putter head is assembled, an upper edge of the mating section of the back body will be disposed underneath the top ledge of the face member. Therefore, a parting line between the face member and the back body will be concealed by the top ledge of the face member and thus will not be visible from directly above the putter head. The face member and the back body are attached to each other by a pair of screws, and a membrane may be placed in the cavity in the rear surface of the face member between the recessed bottom surface thereof and the mating section of the back body. The membrane is preferably formed of an elastomeric material to dampen vibrations and alter the sound made when a golf ball is struck on the front surface of the face member.

DESCRIPTION OF THE PREFERRED EMBODIMENT

Figure 1:
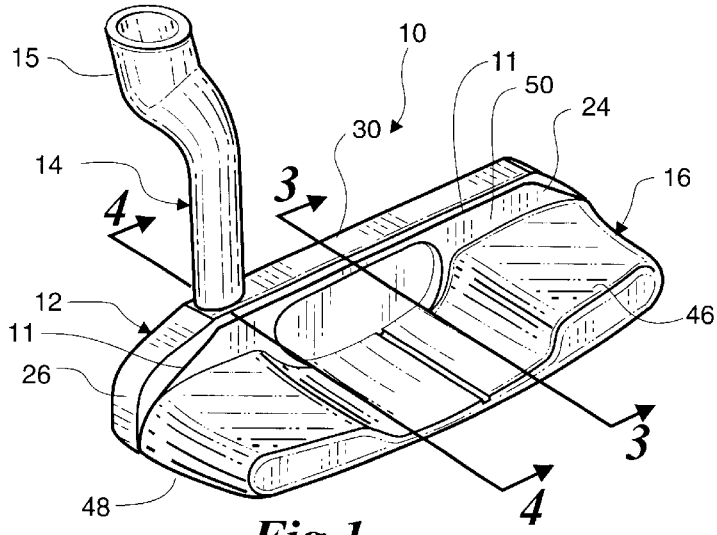
FIG. 1 is a perspective view of an assembled putter head according to one embodiment of the present invention.
Figure 2:
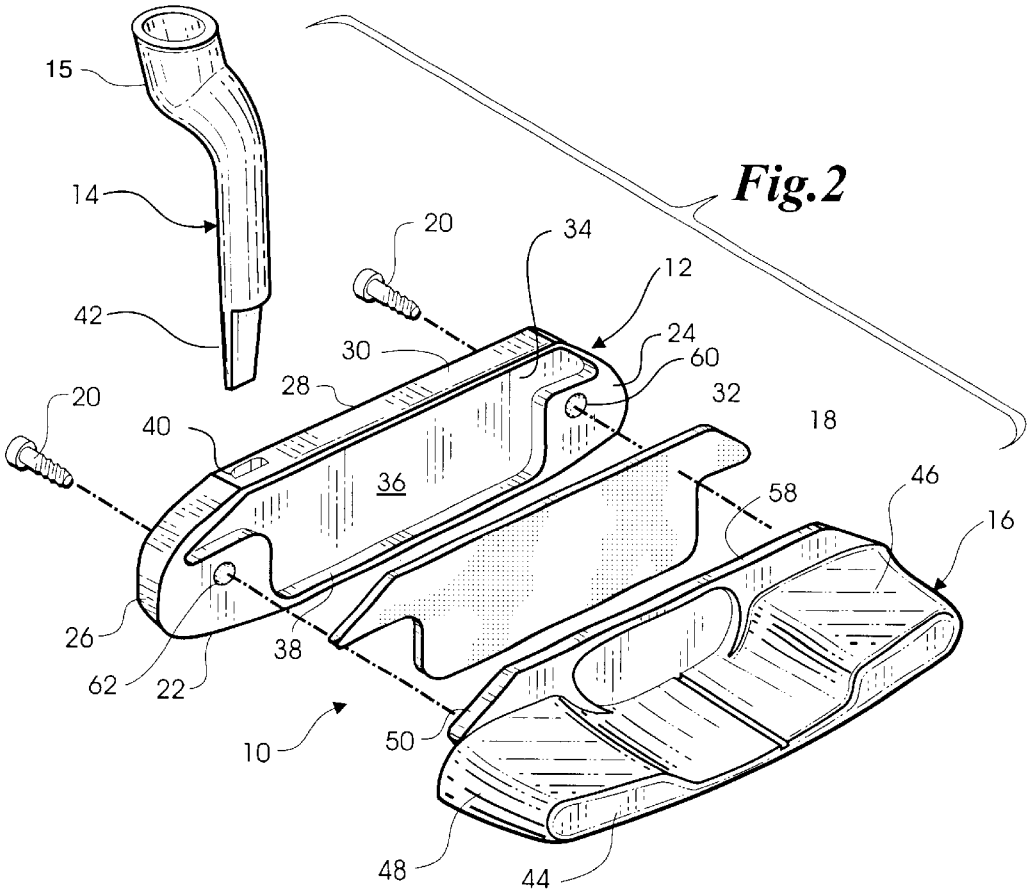
FIG. 2 is an exploded view of the putter head shown in FIG. 1.

Referring to FIG. 1, an assembled golf putter head according to one embodiment of the present invention is indicated generally by the reference numeral 10. The putter head 10, as shown in the exploded view of FIG. 2, is formed of multiple components including a face member 12, a hosel 14, a back body 16 and a membrane 18. These components are held together by a pair of screws 20. The hosel 14 has a boss 15 for receiving one end of a golf shaft (not shown).

Figure 4:
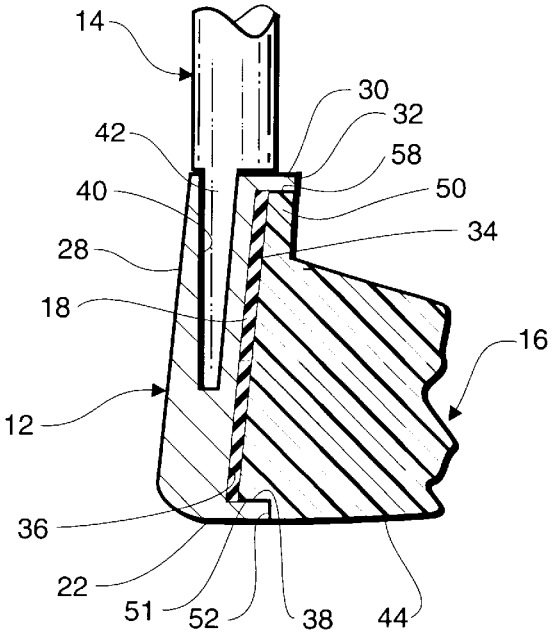
FIG. 4 is an enlarged fragmentary sectional view taken along the line 4—4 in FIG. 1.

The face member 12 has a sole 22, a toe end 24, a heel end 26, a front surface 28 arranged for striking a golf ball (not shown), a top ledge 30 and a rear surface 32. The top ledge 30 is disposed between the front and rear surfaces 28, 32. A cavity 34 is formed in the rear surface 32 with the cavity 34 having a recessed bottom surface 36 circumscribed by a rim surface 38. An upwardly opening socket 40 is formed in the top ledge 30 of the face member 12 for receiving a depending extension 42 of the hosel 14 as shown in FIG. 4. The face member 12 and the hosel 14 are preferably formed of suitable metal such as stainless steel. When both the face member 12 and the hosel 14 are formed of metal, a sintering process may be used to secure the hosel 14 to the face member 12. Alternatively, the hosel 14 may be formed of a suitable synthetic resin and secured to the face member 12 by using an adhesive such as epoxy. It will be apparent that by fabricating the face member 12 and the hosel 14 as separate components and securing them together in the manner indicated, different face members having desired configurations may be provided. The face member 12 is selected from a plurality of differently configured face members (not shown), and the hosel 14 is selected from a plurality of differently configured hosels (not shown). Alternatively, the face member 12 and the hosel 14 may be integrally formed.

Figure 5:
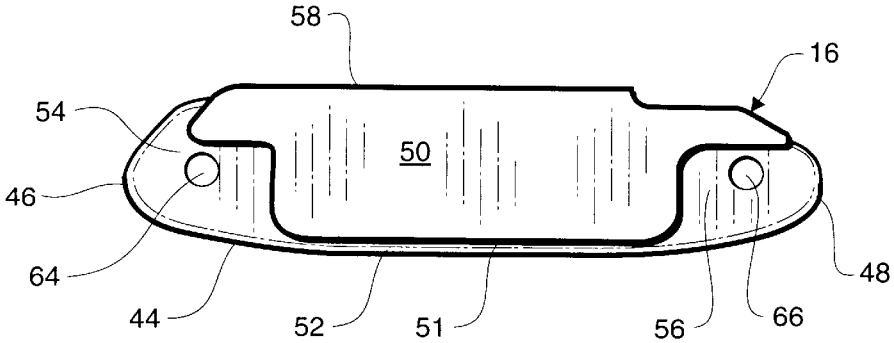
FIG. 5 is an elevational view of one component of the putter head shown in FIGS. 1 and 2.

The back body 16 has a sole 44, a toe end 46, a heel end 48 and a mating section 50 which is shown best in FIGS. 2 and 5. The mating section 50 of the back body 16 is separated along its lower edge 51 from the sole 44 by a lip 52 which extends between front end portions 54 and 56 of the back body 16. The mating section 50 has an elongated upper edge 58 opposite the lower edge 51. It is contemplated that a plurality of differently configured back bodies (not shown) will be fabricated to provide a selection of back bodies having various weights and shapes. The back bodies may be formed of any suitable material such as metal or synthetic resin. The mating section 50 of the back body 16 has a shape that matches the shape of the recessed bottom surface 36 of the face member cavity 34 to provide a proper fit when the face member 12 and the back body 16 are secured together as described below.

Figure 3:
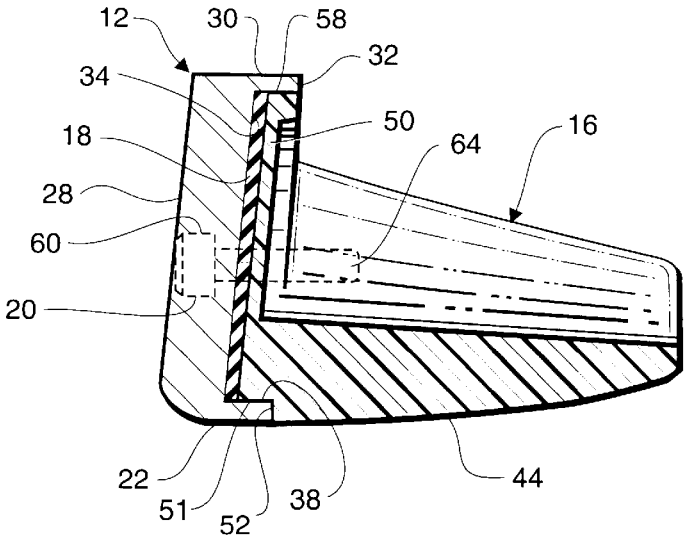
FIG. 3 is an enlarged sectional view taken along the line 3—3 in FIG. 1.

As seen in FIG. 2, the face member 12 is provided with a spaced apart pair of counterbores 60 and 62 formed proximate the toe and heel ends 24 and 26, respectively, with the counterbores 60, 62 extending from the front surface 28 through to the back surface 32. The back body 16 is formed with a spaced apart pair of threaded bores 64 and 66 (FIG. 5) adjacent the toe and heel ends 46 and 48, respectively, which are disposed to axially align with the counterbores 60, 62 in the face member 12 when the back body 16 is secured to the face member 12 by the screws 20. The mating section 50 of the back body 16 is disposed within the cavity 34 of the face member 12 with the upper edge 58 of the mating section 50 lying beneath the top ledge 30 of the face member 12 as shown in FIGS. 3 and 4. Therefore, a parting line 11 (FIG. 1) between the face member 12 and the back body 16 is concealed by the top ledge 30 and is not visible from directly above the putter head 10 such as when a golfer is making a putting stroke with a putter incorporating the putter head 10.

Referring to FIG. 2, it will be understood that the membrane 18 is formed with a shape that matches the shape of the cavity 34 in the face member 12 and the shape of the mating section 50 of the back body 16. As seen in FIGS. 3 and 4, when the putter head 10 is assembled, the membrane 18 is interposed between the recessed bottom surface 36 of the cavity 34 of the face member 12 and the mating section 50 of the back body 16. The membrane 18 is preferably made of an elastomeric material such as foam tape which has adhesive on both sides and which may be die cut into the desired shape. Although the putter head 10 may be assembled without utilizing the membrane 18, it is preferred that the membrane 18 be used because it will absorb vibration and alter the sound made when a golf ball is struck on the front surface 28 of the face member 12.

Figure 6:
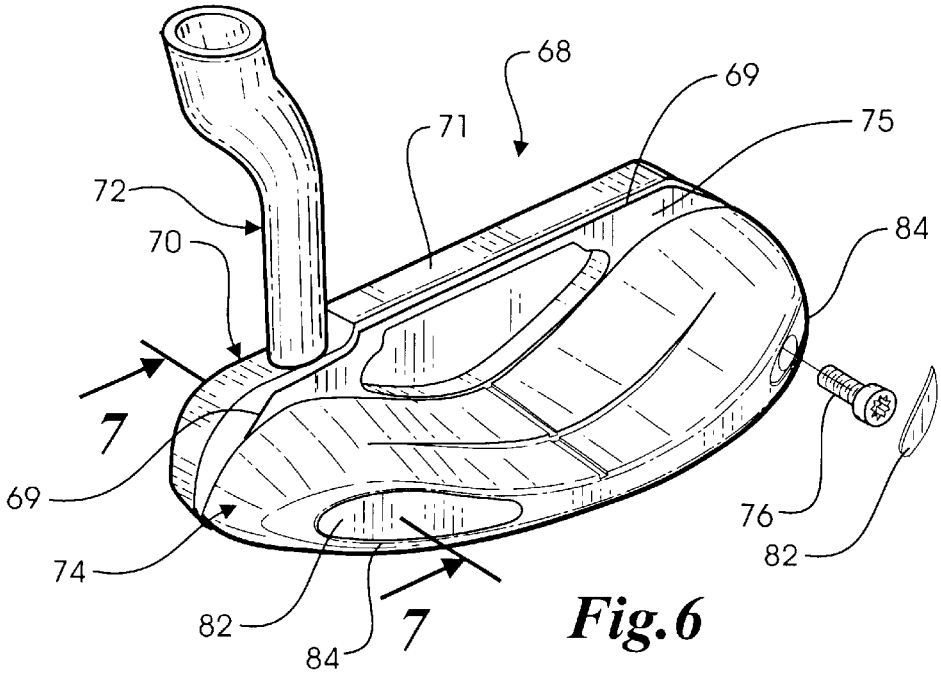
FIG. 6 is a partially exploded perspective view of a putter head according to another embodiment of the present invention.
Figure 7:
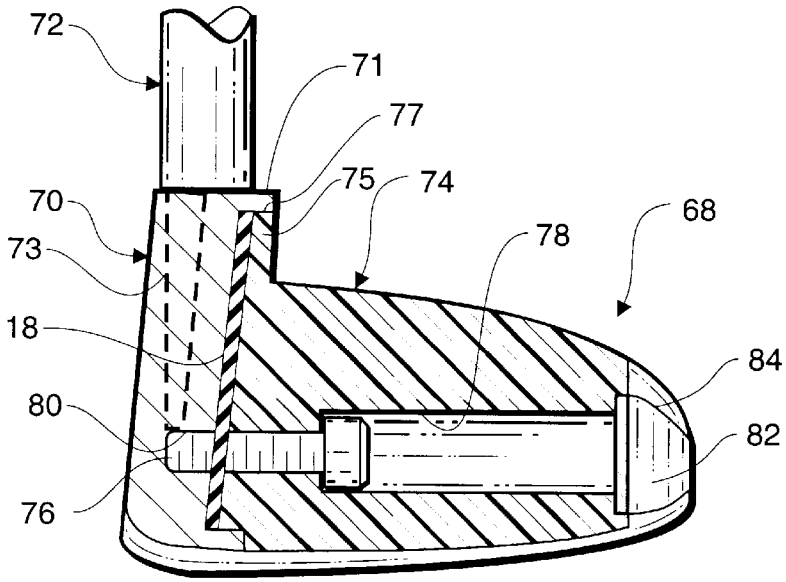
FIG. 7 is an enlarged sectional view taken along the line 7—7 in FIG. 6.

A golf putter head according to another embodiment of the present invention is identified in FIGS. 6 and 7 by the reference numeral 68. The putter head 68 includes a face member 70 and a hosel 72 joined together in the manner described with respect to the face member 12 and the hosel 14 of the putter head 10. The face member 70 has a top ledge 71 that is similar to the top ledge 30 of the face member 12, and the hosel 72 includes a depending extension 73 that is similar to the depending extension 42 of the hosel 14. The putter head 68 also includes a back body 74 with a mating section 75 that is similar to the mating section 50 of the back body 16. A pair of screws 76 (only one of which is shown) are used to secure the face member 70 and the back body 74 together. The screws 76 pass through holes 78 (only one of which is shown) formed in the back body 74 into threaded bores 80 (only one of which is shown) provided in the face member 70. The holes 78 are disposed generally normally with respect to the mating section 75. Plates 82 may be inserted into recesses 84 formed in the back body 74 to conceal the screws 76. The plates 82 may be made of metal or plastic and secured in place with a suitable adhesive. When the putter head 68 is assembled, the mating section 75 of the back body 74 has an upper edge 77 that lies beneath the top ledge 71 of the face member 68 so that a parting line 69 between the face member 70 and the back body 74 is concealed by the top ledge 71.

What is claimed is:

1. A golf putter head comprising:

a face member formed of metal, said face member having a heel end, a toe end, a top ledge extending between said heel and toe ends, a front surface arranged for striking a golf ball, and a rear surface with a cavity formed therein;

a back body formed of synthetic material, said back body having a heel end, a toe end and a mating section disposed in the cavity in said face member, the mating section of said back body having an upper edge that lies beneath the top ledge of said face member when the mating section of said back body is disposed in the cavity in said face member; and a membrane formed of elastomeric material, said membrane being disposed in said cavity and positioned between a bottom surface of said cavity and the mating section of said back body in order to absorb vibration when the front surface of said face member strikes a golf ball.

2. The golf putter head of claim 1, further comprising a hosel extending upwardly from said face member for receiving one end of a golf shaft.

3. The golf putter head of claim 1, wherein said membrane has a shape that matches both the bottom surface of said cavity and the mating section of said back body.

4. The golf putter head of claim 1, wherein said face member also has a sole.

5. The golf putter head of claim 1, wherein said back body includes a threaded bore adjacent the heel end thereof and another threaded bore adjacent the toe end thereof, and further comprising a pair of screws extending through the heel and toe ends of said face member into said threaded bores to secure said face member and said back body together.

6. The golf putter head of claim 1, wherein said face member includes a threaded bore adjacent the heel end thereof and another threaded bore adjacent the toe end thereof, and further comprising a pair of screws extending through the heel and toe ends of said back body into said threaded bores to secure said face member and said back body together.

* * * * *